United States Patent [19]

Konig

[11] Patent Number: 4,849,096

[45] Date of Patent: Jul. 18, 1989

[54] CLEANING ARRANGEMENT FOR SUSPENSIONS

[75] Inventor: Helmut Konig, Annweiler, Fed. Rep. of Germany

[73] Assignee: J.M. Voith GmbH, Heidenheim, Fed. Rep. of Germany

[21] Appl. No.: 883,522

[22] Filed: Jul. 8, 1986

[30] Foreign Application Priority Data

Jul. 17, 1985 [DE] Fed. Rep. of Germany ..... 3525483

[51] Int. Cl.[4] ..... B04C 7/00

[52] U.S. Cl. ..... 209/211; 162/4; 162/55; 210/512.2

[58] Field of Search ..... 209/211; 210/788, 787, 210/512.1, 512.2; 162/4, 55, 59, 380

[56] References Cited

U.S. PATENT DOCUMENTS

| | | | |
|---|---|---|---|
| 2,756,878 | 7/1956 | Herkenhoff | 209/211 |
| 3,237,763 | 3/1966 | Wikdahl | 209/211 X |
| 3,301,745 | 1/1967 | Coppick et al. | 162/55 |
| 3,486,619 | 12/1969 | Grundelius et al. | 162/4 X |
| 3,901,725 | 8/1975 | Bond et al. | 209/211 X |
| 4,144,087 | 3/1979 | Chwalek et al. | 209/211 X |
| 4,222,529 | 9/1980 | Long | 209/211 X |
| 4,226,726 | 10/1980 | Rehm | 209/211 X |
| 4,283,232 | 8/1981 | Best | 209/211 X |
| 4,414,112 | 11/1983 | Simpson et al. | 210/512.1 |
| 4,462,899 | 7/1984 | Wambsgans | 209/211 |
| 4,572,787 | 2/1986 | Robinson | 209/211 X |
| 4,578,199 | 3/1986 | Peel et al. | 209/788 |
| 4,622,132 | 11/1986 | Chupka | 209/211 |

FOREIGN PATENT DOCUMENTS

| | | | |
|---|---|---|---|
| 1078998 | 4/1960 | Fed. Rep. of Germany | 210/512.2 |
| 3124959 | 1/1983 | Fed. Rep. of Germany | 162/4 |
| 84/03236 | 8/1984 | PCT Int'l Appl. . | |

OTHER PUBLICATIONS

"Papers presented at an International Conference on Hydrocyclones", BHRA-pp. 178-187 (209-211).

*Primary Examiner*—Johnny D. Cherry
*Assistant Examiner*—Edward M. Wacyra
*Attorney, Agent, or Firm*—Albert L. Jeffers; Richard L. Robinson

[57] ABSTRACT

The apparatus has a main line having stages of cleaning batteries (S1-S5). The respective battery of each individual stage consists of cleaners such as hydroclones which produce three fractions. The medium fraction is conveyed from stage to stage. The heavy fraction of the first stage is cleaned in a first secondary circuit (N1) and the light fraction of all main line stages S1 to S5 is cleaned further in a second secondary circuit N2. The heavy fraction of the main line stages (S2 to S5) following the first stage (S1) is conveyed as accept to a paper machine reservoir, as is the light fraction of the first secondary circuit (N1). The heavy fraction of the second secondary circuit (N2) is conveyed to the inlet of the main line first stage (S1), whereas the light fraction of this second secondary circuit (N2) is cleaned further. The hydroclones of the two secondary circuits may be of the type which is capable of preparing three fractions. The light fraction of these secondary circuit cleaners may be discared, if necessary, after brief screening. The cleaners which are capable of producing three fractions are preferably of the type in which the extraction of the fractions occurs at the lower outlet aperture of a thin conical portion.

9 Claims, 2 Drawing Sheets

CLEANING ARRANGEMENT FOR SUSPENSIONS

BACKGROUND OF THE INVENTION

This invention relates generally to a cleaning apparatus for suspensions, in particular fibrous suspensions. More particularly, this invention relates to a cleaning apparatus in which a number of cleaners, such as hydrocyclones, are arranged in several consecutive stages, of which the initial stages comprise a plurality of cleaners arranged in parallel to form a battery, with at least one main line being provided in which a plurality of cleaners adapted to prepare three fractions are arranged in multiple stages. A first fraction is extracted from a vortex core created in the cleaner through a central extraction pipe positioned within the cleaner body, or its vortex core. This first fraction is enriched with lightweight soil to the greatest degree. A second fraction is extracted through an external extraction pipe which is arranged coaxially to the central extraction pipe. This second fraction is enriched with less lightweight soil, and partially with heavy soil. A third fraction is extracted radially outwardly from the cleaner body at its outlet aperture and is hardly enriched at all with any lightweight soil. This third fraction predominantly contains specifically heavier parts than the lightweight soil.

Cleaning apparatus for suspensions of this general type is known from the journal "Wochenblatt fur Papierfabrikation", (Weekly Magazine for Paper Manufacture), 1966, Page 389 to 400, in particular see FIGS. 8 and 11.

The precision cleaning hydrocyclones, also referred to as cleaners, used in these prior art installations are generally equipped with a thin, conical lower part in which the aperture angle of the cone is in the range of between 4° and 10°, preferably from 6°–8°. These prior art cleaners are interconnected into batteries to form one stage at a time, as is known, for instance, from U.S. Pat. No. 4,462,899 and WO 84/03236.

In the apparatus known from the above-mentioned "Wochenblatt", the main quantity of accept transported in the direction of the machine reservoir, if necessary after final cleaning by means of very fine screens, has already been removed from the first stage of the main group of cleaners, which is the only group provided, and the other stages of the main group are switched in cascade.

In these cleaners of the precision cleaning stages, an attempt is made to remove the medium-weight soil completely from the fibrous suspension, to which the adhesive portions also specifically belong and which are found in particle form in the fibrous suspensions. With the prior art type of apparatus, and in particular, the prior art switching arrangements having such cleaners, the soil removal process has not been entirely satisfactory.

SUMMARY OF THE INVENTION

The object of the invention is to provide apparatus in which there is the most extensive separation of the suspended soil, specifically the suspended light-weight soil and at the same time the adhesive portion in particular.

This object is achieved in accordance with the invention by apparatus which includes a main line having stages of cleaning batteries. The respective battery of each individual stage consists of cleaners, such as hydroclones, which produce three fractions. The medium fraction is conveyed from stage to stage. The heavy fraction of the first stage is cleaned in a first secondary circuit and the light fraction of all main line stages is cleaned further in a second secondary circuit. The heavy fractions of the main line stages which follow the first stage is conveyed as accept to a paper machine reservoir. The light fraction of the first secondary circuit is also conveyed to the paper machine reservoir. The heavy fraction of the second secondary circuit is conveyed to the inlet of the main line first stage whereas the light fraction of this second secondary circuit is cleaned further. The hydrocyclones of the two secondary circuits may be of the type which is capable of preparing three fractions. The light fraction of the secondary circuit cleaners may be discarded, if necessary, after brief screening. The cleaners which are capable of producing three fractions are preferably of the type in which the extraction of the fractions occurs at the lower outlet aperture of a thin conical portion.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figures 1, 2:
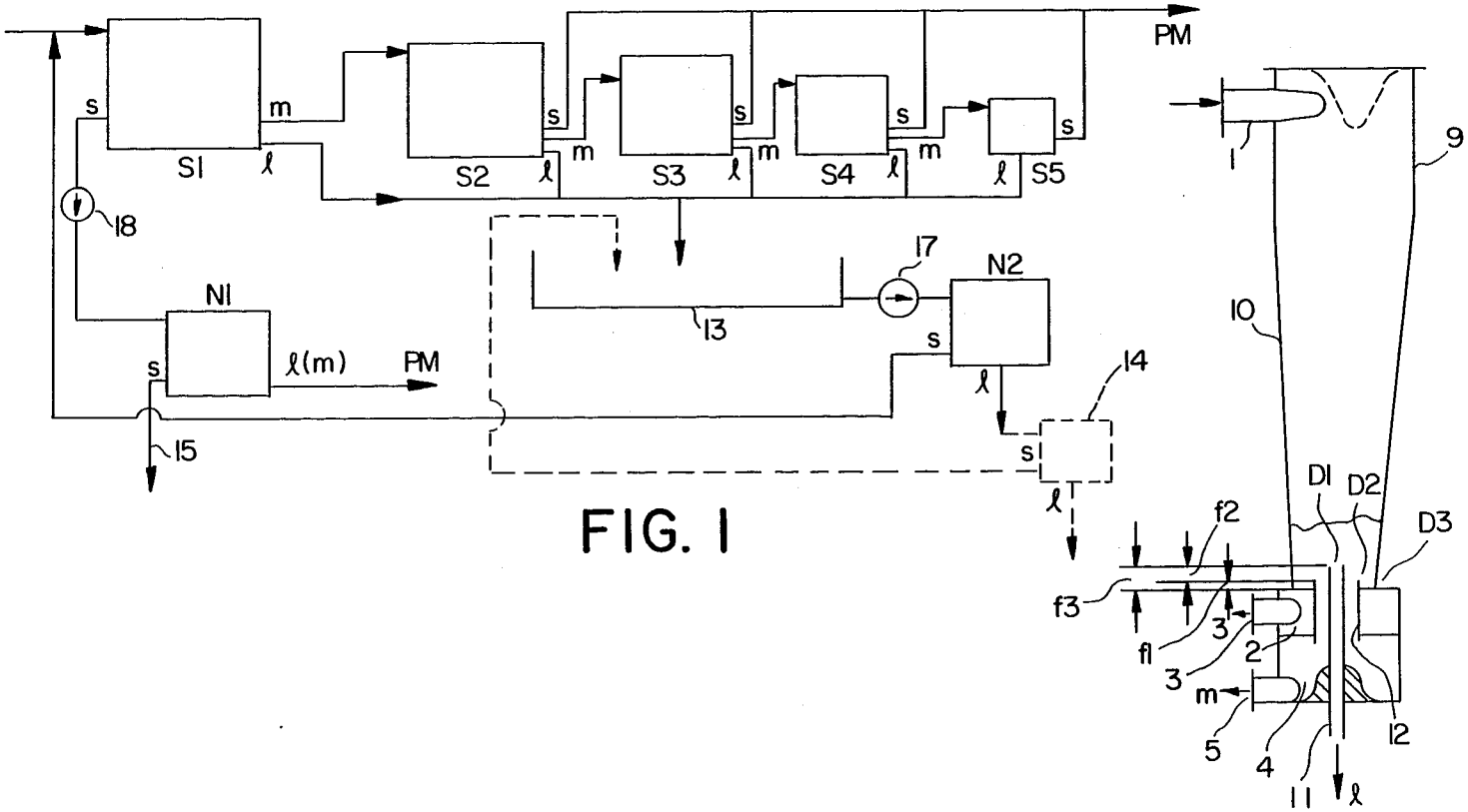
FIG. 1 shows a schematic diagram of a plant arranged in accordance with the invention.
FIG. 2 shows a diagrammatic sketch of an associated cleaner for the plant of FIG. 1.

Referring to FIGS. 1 and 2, the fibrous suspension is firstly fractionated in a first stage Sl of a cleaner battery of the main line. This stage contains a plurality of cleaners connected in parallel. These cleaners are constructed as shown in FIG. 2. An inlet is designated by 1, and outlets for different fractions are shown at 3 and 5. Furthermore, the cleaner has a centrally arranged lightweight soil extraction pipe 11, which projects a certain distance into the conical part 10 of the cleaner. Above conical part 10 there is a cylindrical inlet part 9. Outlets 3 and 5 are connected to outlet chambers 2 and 4. A medium-weight fraction reaches chamber 4, and this fraction is separated as a further fraction by means of the outlet pipe 12 which is arranged coaxially to the central pipe 11. At the same time, the heavy fraction is collected in the extraction chamber 2, which, in the cleaner design of the instant invention, contains practically no specifically lightweight substances, and in particular, no lightweight impurities, to which those impurities with a large surface area also belong.

The outlets for the different fractions of the cleaner of FIG. 2 are designated as s, m and l, and are also so designated in FIG. 1. In practice, the outlets designate the heavy fraction (s), a medium-weight fraction (m)

and a lightweight fraction (l), and the latter also means the lightweight components, in particular, the lightweight impurities, to which the adhesive portions also predominantly belong. The heavy fraction (s) of this cleaner design contains a percentage in the range of 20% -50%, preferably close to 50%, of the supplied quantity.

Stages S1–S5 form the main line in FIG. 1 and consist of cleaners of the design shown in FIG. 2. At the end of this main line a total of approximately 50% of the accept which can be supplied to the paper making machine (PM) is obtained. From the stages of the main line which follow the first stage, namely S2–S5 the heavy fraction (S) is supplied to the paper machine as the accept fraction, while the medium fraction (m) is conveyed from one stage to the next successive one. Of course, pumps are necessary for this transfer, but these pumps are omitted from the drawings for the sake of clarity.

The lightweight fraction (l) of stages S1–S5 of the main line is collected in a collection reservoir 13 and fractionated further in a secondary circuit N2. This stage N2 of the secondary circuit consists of a battery of cleaners arranged in parallel and receives the suspension from reservoir 13 via pump 17. Preferably the cleaners of stage N2 are not of the type shown in FIG. 2. Instead, hydrocyclones are used which only prepare two fractions, i.e., a heavy and a light fraction. As shown, the heavy fraction is returned to the inlet of the first stage S1 of the main line. As shown by broken lines, the light fraction can be cleaned further in a further cleaner stage 14 of the secondary circuit. The light fraction of stage 14 is then discarded, whereas the heavy fraction may again be supplied to the collection reservoir 13 in which the light fraction of the main line is collected.

The heavy fraction (s) of the first stage S1 of the main circuit is transferred by pump 18 to a subsequent secondary treatment stage N1, consisting of a battery of cleaners which also prepare two fractions. Since the heavy fraction (s) of the main line first stage S1 practically no longer contains any light impurities, in this case the procedure may be to extract the heavy fraction as heavy soil from stage N1 and thus the light fraction, which then only contains accept, may be supplied to the paper making machine PM. The heavy fraction which leaves stage N1 via line 15 may then be cleaned further in another connected cleaner stage, in a similar way as is shown by broken lines 14 in connection with secondary circuit N2. In practice, it has been shown that the maximum loss of fibrous material which can be achieved with the circuit according to the present invention is 0.3%.

The arrangement shown in FIG. 1 may be modified by providing the medium fraction (m) of main line stage S4 to the inlet of the first stage S1 of the main line, instead of to the last stage S5 of the main line. In this case, stage S1 should certainly be provided with a greater number of cleaners.

The cleaners of the stages of secondary circuit N1 and N2 are not necessarily undirectional cleaners, such as shown in FIG. 2, but are cleaners in which the light fraction at the wide cleaner end is removed by means of a central extraction pipe. With these cleaners, a distinct and clear separation of the heavy and light fractions to be removed is achieved.

As mentioned, the type of cleaner used for the stages S1–S5 of the main line, as shown in FIG. 2, is a unidirectional cleaner, in which the direction of flow does not essentially alter from the entrance to the exit, and the following dimensions were found to be favorable: The diameter D2 of the external coaxial extraction pipe 12 for the medium fraction should be no greater than approximately 75% to 85% of the diameter of the outlet D3 aperture of conical part 10 of the cleaner body. However, diameter D2 will also preferably be not less than 60% of the outlet diameter D3 of the conical part 10 of the cleaner body. Furthermore, coaxial outer pipe 11 should project approximately at least 4 mm and the inner central pipe 8 should project approximately at least 20 to 60 mm into the conical cleaner part 10. This insertion depth could, however, also vary somewhat in relation to the coaxial outer pipe 11, and in fact, could vary approximately between 0 and 40 mm. However, here there should be an overlap of approximately 15 to 20 mm at least by which the inner pipe 12 overlaps the outer coaxial pipe 11. In FIG. 2, this would then be the dimension $f2=f3-f1$.

Of course, the type of fibrous suspensions, i.e., whether the waste paper contains wood or is woodfree, and possibly the degree of soiling as well, also play a role in the variation of these dimensions. The processing consistency of the cleaner, in particular of the main line, should have a solid content of between 0.4% and 1% of the total weight of the suspension (absolutely dry in the case of fibrous suspensions).

The quantities of the individual fractions extracted from the cleaners of the main circuit may also be varied to a large extent. However, in this respect, it has proved to be favorable to set the heavy soil fraction (s) at 50% and the light fraction (1) at between 5% and 10%. Previously it was customary to select a maximum of 15% for the heavy fraction, with which substantially worse results were obtained, albeit with different cleaner designs, than with the arrangement according to the invention.

Figure 3:
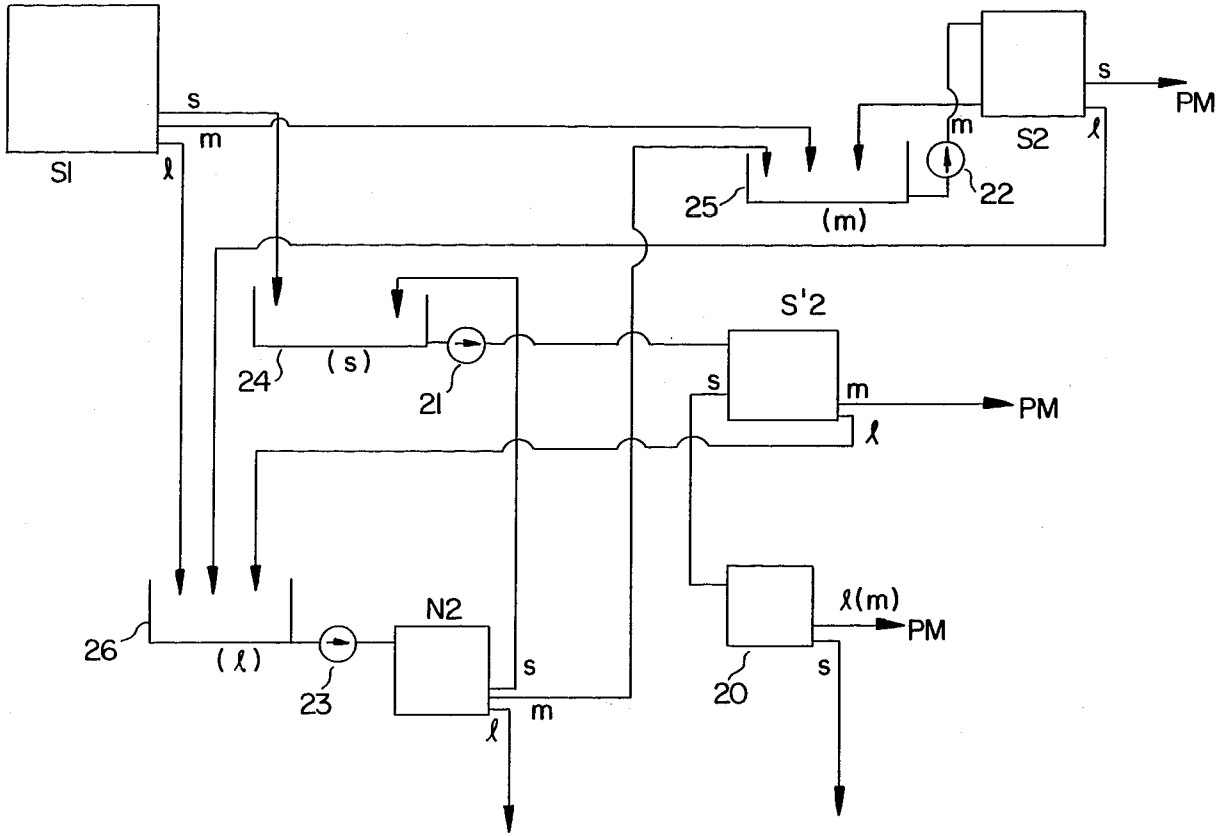
FIG. 3 shows another embodiment of the invention.

Of course, it would also be possible, as shown in the arrangement of FIG. 3, to substitute for the secondary cleaner circuit N1 cleaners of a subsequent treatment stage for separating into three fractions the heavy fraction (s) of the first stage S1, and then to treat the medium fractions (m) as the accept fraction. The light fraction (1) would then also be collected in collection reservoir 13. Furthermore, stages S3-S5 of the main line could also be omitted and the medium fraction (m) of stage S2 could again be returned to the inlet of this stage.

Such an arrangement is shown in FIG. 3, in which moreover almost exclusive use is made of cleaners of the type which prepares three fractions (s), (m) and (l), i.e., preferably constructed in accordance with FIG. 2. Here only the last subsequent treatment stage 20 for the heavy fraction of the first stage Sl is given a cleaner 20 of a different design, i.e, a design in which only two fractions are prepared. With cleaners of this design the question, of course, arises whether the fraction which is not heavy should be designated by (l) or (m). In any case, it is the counter-fraction to heavy fraction (s).

In FIG. 3, pumps 21, 22 and 23 and reservoirs, 24, 25 and 26 are also shown.

The lightweight fraction (l) of secondary circuit N2 can be regarded as reject, and may possibly undergo further treatment in a vibrating screen, whereas the heavy fraction (s) of stage 20 of FIG. 3 is to be regarded as soil to be discarded.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A cleaning arrangement for separating an accepts fraction from suspensions, comprising:

a main line of consecutive hydrocyclone cleaner stages, each cleaner stage configured to produce three fractions, including a light fraction, a medium fraction and a heavy fraction, the heavy fraction from each cleaner stage subsequent to the initial cleaner stage of the main line constituting an accepts fraction;

means for conveying the medium fraction from at least the initial cleaner stage of said main line to a next consecutive cleaner stage of said main line;

a firist secondary cleaner stage configured to produce at least two fractions including a heavy fraction and a counter-fraction to the heavy fraction, the counter-fraction constituting an accepts fraction;

means for conveying the heavy fraction from the initial cleaner stage of said main line to said first secondary cleaner stage;

a second secondary cleaner stage configured to produce at least two fractions including a heavy fraction and a light fraction; and means for conveying the light fraction from each of the cleaner stages of said main line to said second secondary cleaner stage.

2. The cleaning arrangement of claim 1, and further including means for conveying the heavy fraction of said second secondary cleaner to the initial cleaning stage of said main line.

3. The cleaning arrangement of claim 1, in which said first secondary cleaner stage is configured to produce a third fraction comprising a light fraction.

4. The cleaning arrangement of claim 3, and further including means for conveying the light ffraction from said first secondary stage to said second secondary stage.

5. The cleaning arrangement of claim 1, in which said second secondary cleaner stage is configured to produce a third fraction comprising a medium fraction.

6. The cleaning arrangement of claim 5, and further including means for conveying the heavy fraction of said second secondary cleaner stage to said first secondary cleaner stage, and means for conveying the medium fraction of the second secondary cleaner stage to the next consecutive cleaner stage of the main line subsequent to the initial cleaner stage of the main line.

7. The cleaning arrangment of claim 1, and further including means for conveying the heavy fraction of said second secondary cleaner stage to said first secondary cleaner stage.

8. The cleaning arrangement of claim 1, and further including means for conveying the medium fraction of the next consecutive cleaner stage of the main line subsequent to the initial cleaner stage of the main line to said selfsame next consecutive cleaner stage.

9. The cleaning arrangement of claim 1, in which said first secondary cleaner stage is configured to produce only two fractions, the counter-fraction to the heavy fraction constituting a light fraction.

* * * * *